US006328536B1

(12) United States Patent
Zebuhr

(10) Patent No.: US 6,328,536 B1
(45) Date of Patent: Dec. 11, 2001

(54) RECIPROCATING LOW PRESSURE RATIO COMPRESSOR

(75) Inventor: William Zebuhr, Nashua, NH (US)

(73) Assignee: Ovation Products Corporation, Nashua, NH (US)

( * ) Notice: Subject to any disclaimer, the term of this patent is extended or adjusted under 35 U.S.C. 154(b) by 0 days.

(21) Appl. No.: 09/651,402

(22) Filed: Aug. 29, 2000

Related U.S. Application Data

(63) Continuation-in-part of application No. 09/209,947, filed on Dec. 11, 1998, now abandoned.

(51) Int. Cl.[7] ..... F04B 3/00; F04B 5/00; F04B 25/00

(52) U.S. Cl. ..... 417/259; 62/117

(58) Field of Search ..... 417/238, 266, 417/259, 243, 45, 514, 417; 60/595, 670; 62/6, 117, 292, 498; 92/71; 123/53.1, 90.1, 48 R; 203/24; 202/180, 176; 310/15; 137/596.18

(56) References Cited

U.S. PATENT DOCUMENTS

| | | | | |
|---|---|---|---|---|
| 2,425,813 | | 8/1947 | Kuntz . | |
| 3,771,918 | * | 11/1973 | Winter | 417/266 |
| 3,861,222 | | 1/1975 | Braun et al. . | |
| 4,035,243 | * | 7/1977 | Katz et al. | 203/24 |
| 4,105,371 | * | 8/1978 | Savage et al. | 417/238 |
| 4,307,997 | * | 12/1981 | Richards et al. | 417/211 |
| 4,308,720 | * | 1/1982 | Brandstadter | 60/595 |
| 4,369,633 | * | 1/1983 | Snyder | 62/117 |
| 4,390,322 | * | 6/1983 | Budzich | 417/243 |
| 4,413,474 | | 11/1983 | Moscrip . | |
| 4,440,601 | * | 4/1984 | Katz et al. | 203/24 |
| 4,510,894 | * | 4/1985 | Williams | 123/48 R |
| 4,536,258 | * | 8/1985 | Huhta-Kolvisto | 202/180 |
| 4,561,464 | * | 12/1985 | Frantz | 137/596.18 |
| 4,580,414 | * | 4/1986 | Engelhard | 62/498 |
| 4,589,257 | * | 5/1986 | Schaich | 60/670 |
| 4,718,832 | * | 1/1988 | Takahashi | 417/417 |
| 4,734,167 | * | 3/1988 | Goeldner | 202/178 |
| 4,787,823 | * | 11/1988 | Hultman | 417/45 |
| 4,792,289 | * | 12/1988 | Nieratschker | 417/259 |
| 4,832,578 | * | 5/1989 | Putt | 417/266 |
| 4,878,819 | * | 11/1989 | Bozoyan | 417/514 |
| 4,885,017 | * | 12/1989 | Fleischmann | 62/6 |
| 4,909,716 | * | 3/1990 | Orosz et al. | 418/201 |
| 5,483,929 | * | 1/1996 | Kuhn et al. | 123/90.1 |
| 5,533,358 | * | 7/1996 | Crandall et al. | 62/292 |
| 5,638,736 | * | 6/1997 | Murakami et al. | 92/71 |
| 5,720,177 | | 2/1998 | Derrick et al. . | |
| 5,818,131 | * | 10/1998 | Zhang | 310/15 |
| 5,983,845 | * | 11/1999 | Yanagslawa | 123/53.1 |
| 6,015,270 | * | 1/2000 | Roth | 417/259 |

FOREIGN PATENT DOCUMENTS

| | | |
|---|---|---|
| 213478 | 2/1941 | (CH) . |
| 714705 | 11/1941 | (DE) . |
| 803938 | 10/1936 | (FR) . |
| 263053 | 12/1926 | (GB) . |
| 00/34656 | 6/2000 | (WO) . |

OTHER PUBLICATIONS

Yeaple, Franklin D., Fluid Power Design Handbook, 1984, pp. 131–133, Marcel Dekker, Inc., New York, New York.

* cited by examiner

*Primary Examiner*—Teresa Walberg
*Assistant Examiner*—Leonid Fastovsky
(74) *Attorney, Agent, or Firm*—Cesari and McKenna, LLP

(57) ABSTRACT

A reciprocating compressor capable of producing a steady-state, continuous, non-pulsing outflow at volumes less than 25 gallons per hour. The compressor utilizes at least two pistons driven in a near axial manner with any lateral forces imparted to the compressor subsequently removed. The compressor is useful in a vapor compression distillate system but could also be adapted to pump liquids. A rotating cam is provided which through cam followers drives the pistons such that the compression stroke of one compensates for the vibrational force introduced into the apparatus by another piston caused by change in that piston's direction.

32 Claims, 15 Drawing Sheets

RECIPROCATING LOW PRESSURE RATIO COMPRESSOR

CROSS REFERENCE TO RELATED APPLICATIONS

This application claims the benefit in the form of a continuation-in-part under 37 CFR 1.53(b)(1) of currently pending parent application, Ser. No. 09/209,947 filed Dec. 11, 1998, now abandoned by the same inventor.

FIELD OF THE INVENTION

The present invention relates generally to a compressor, which compresses fluid by use of reciprocating pistons.

BACKGROUND OF THE INVENTION

This invention relates generally to the technology of energy and liquid recycling and more particularly to an improved compressor apparatus for use in such technology. Such an improved compressor has great potential for use in vapor compression distillation and other applications in which low levels of vibration and steady flow output and constant pressure are desirable.

Vapor compression distillation is well known and understood in the broader field of distillation of liquids. In a vapor compression system, a liquid supply is at least partially evaporated. The vapor extracted is then adiabatically compressed thus elevating the temperature at which the vapor will recondense to some value higher than its original evaporative temperature. When the vapor recondenses it returns all of the latent heat that originally went into evaporating it back to the system The only energy placed into the system which is not recovered is the energy required to compress the vapor.

Vapor compression distillers generally make use of centrifugal compression, due to the simplicity, cost-effectiveness, and reasonable efficiency of the centrifugal process. However, as the distiller is scaled downward, centrifugal compression becomes more problematic. Efficiency falls off rapidly below 25 gallons of distillate per hour. As the output of the distiller decreases so too does the efficiency of the centrifugal compressor.

Compressors operating on the principle of reciprocation are more efficient in smaller sizes but generally are not suitable for vapor compression systems. Some of the problems associated with reciprocation are: 1) a piston-based compressor is more mechanically complicated and generally requires lubrication of the piston rings within the cylinder; 2) a piston-based compressor exhibits more severe wear characteristics; and 3) a piston-base compressor introduces pressure pulses due to the action of the piston.

There is no theoretical lower output limit to a vapor compression distillation unit. However, the practical problems associated with low output vapor compression which limit its feasibility are due to: 1) inefficiencies in heat transfer between the vapor and the incoming liquid; and 2) the compressor design. Low output vapor compression distillation is desirable for small incoming liquid streams such as commonly occur in residential waste collection systems. By distilling the water from a household waste stream and recycling it for use in watering the lawn, the garden or even as potable water great savings in waste management will be gained. Other uses certainly abound for systems operating at volumes less than 25 gallons per hour.

SUMMARY OF THE INVENTION

The invention in its broadest form resides in a compressor apparatus comprising a housing capable of being pressurized said housing having a plurality of chambers; a plurality of pistons, one slidably contained within each of said chambers for reciprocation; driving means for reciprocating said pistons within each chamber substantially axial direction without introducing lateral forces, means for introducing a vapor into a first of said chambers to be compressed by a first of said pistons; means for continuously pumping said compressed vapor from said first chamber successively through remaining of said plurality of chambers; means for removing said compressed vapor in a constant flow from a last of said chambers; and means for maintaining an interior of said housing at a pressure higher than ambient.

A preferred embodiment of the present invention provides a positive displacement compressor suitable for use in a vapor compression distiller characterized by an output volume of less than 25 gallons per hour.

Embodiments described hereinafter provide: (i) a compressor which produces a substantially steady output, (ii) a compressor that has the added ability to run with little or no lubrication in the piston cylinder, (iii) a compressor exhibiting minimal vibrational tendencies, (iv) a compressor suitable for use in a liquid waste disposal system, all of which may be adaptable to pump liquids.

As described hereinafter, there is provided a positive displacement compressor in which two pistons are arranged co-axially within co-axially aligned piston cylinders. These pistons being driven by a cam, and the piston strokes are timed accordingly to produce an even output flow. Lateral forces imposed by the cam on cam followers are absorbed by links or slides that impart purely axial loads on the pistons. Substantial elimination of the lateral forces eradicates side loads, resultant wear, and the necessity of piston ring lubrication. By timing the pistons to move in opposite directions, the accelerations associated with reversing each piston's vector of travel counteracts one another so as to minimize vibration.

In addition to maintaining a constant flow system characterized by negligible vibration, the alignment of the cylinders, combined with the valve sequencing and piston stroke timing, achieve a constant flow system

BRIEF DESCRIPTION OF THE DRAWINGS

The novel features considered characteristic of the invention are set forth in the appended claims. The invention itself, however, both as to its construction and its method of operation, together with additional objects and advantages thereof, will best be understood from the following description of the specific embodiments when read and understood in connection with the accompanying drawings.

THE DETAILED DESCRIPTION OF THE PREFERRED EMBODIMENTS

Overview of tire Preferred Embodiments

Figure 1:
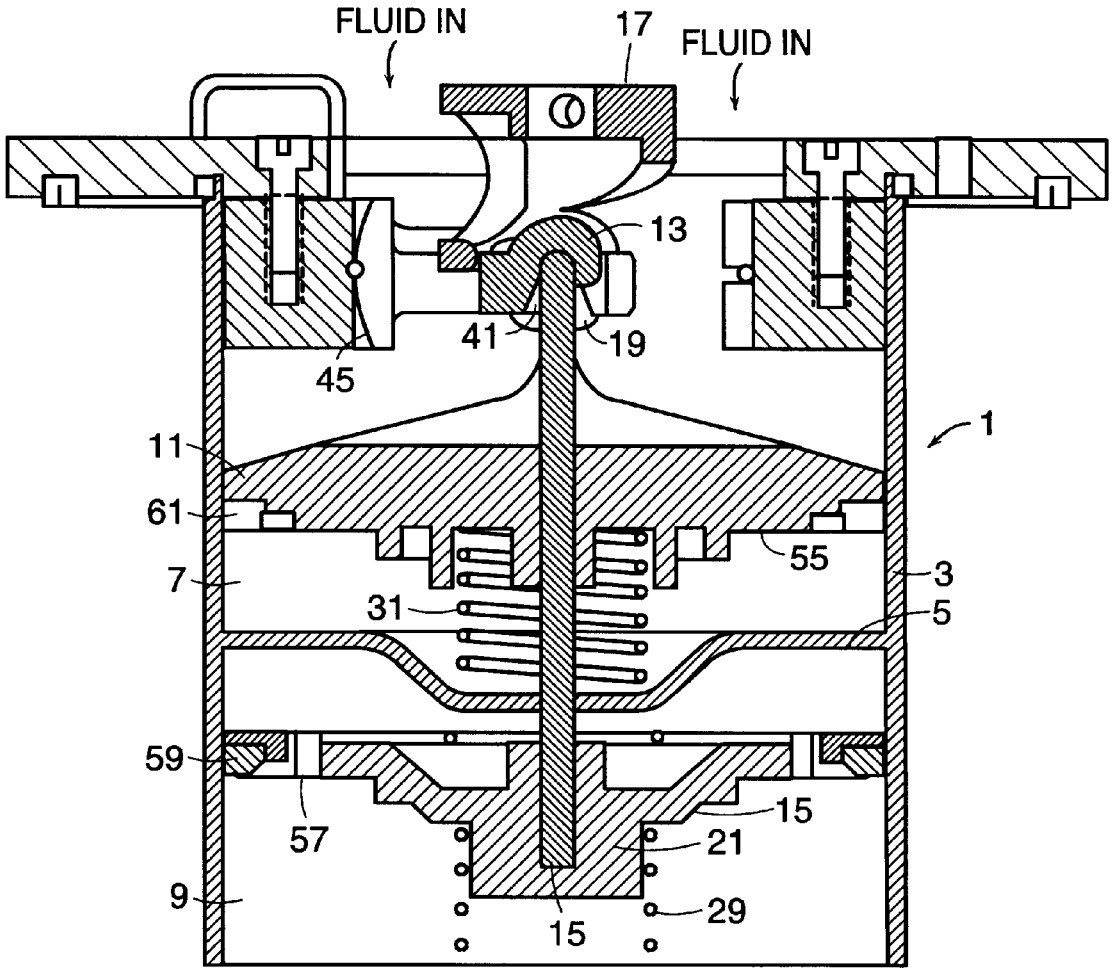
FIG. 1 is a cross-sectional elevation depicting one preferred embodiment of a compressor in accordance with a preferred embodiment of the invention.

In FIG. 1, a compressor 1 comprises; a cylinder 3 divided into a first chamber 7 and a second chamber 9 by a dividing wall or partition 5, pistons 11 and 21 which are made to reciprocate respectively within the chambers 7 and 9, and means for driving the pistons in a substantially axial manner.

It should be understood that though the compressor 1 has been described and will hereafter be described as having two pistons, the number of pistons utilized does not define the invention. The importance placed upon the number of pistons is based solely upon the ability of one piston's motion to be timed such that it counteracts another piston's motion thereby evening out flow and minimizing vibration. The constant flow and vibration-less operation of the compressor are the critical features of the described embodiment, not the number of pistons required to realize this. Though the use of a single piston would not seem to accommodate this requirement, other means for damping vibration could be utilized in conjunction with means to create even flow. More appropriately, some number of pistons in excess of two would perform the function in a more direct fashion however the advantages gained by using a quantity of pistons in excess of two is not considered to be worth the added complexity. As such, two pistons are considered to be the most appropriate compromise between the desired function and complexity.

What is needed is a compressor suitable to operate a small vapor compression distiller, one that will enable proper operation of a distiller even at levels as low as those producing a fraction of a gallon of distillate per hour.

The instant invention is comprised of mutually encased, coaxially mounted cylinders, whose pistons are driven by separate shafts, and operate in opposing directions. Not only does this configuration allow for (the above described) constant flow system, the opposing direction action of the pistons works as a harmonic balancing system as the each of the opposing pistons cancels the axial output of the other.

In the instant design, fluid compressed by the first piston is channeled directly to the upper chamber of the second piston housing.

Upon entering the upper cylinder housing of the second piston, the fluid is passed through the piston itself and introduced to the lower chamber of the second piston casing, via an opening in the piston. The opening in the second piston is covered by a valve, (preferably a spring return check valve or some other kind of one way valve), which, opens during the piston's upstroke, allowing the fluid to pass to the lower chamber. Thus, the fluid flows directly through the piston and into the lower chamber, to be pumped out as compressed fluid. The fluid is then discharged from the system via an opening in the lower chamber of the second piston casing.

Since the second piston has nothing within which to contain the volume of fluid, its compression stroke exists, in essence, as a pumping stroke, which pushes compressed fluid out of the lower chamber and subsequently out of the compression system.

As stated above, piston alignment and timing, (moving in opposite direction and opposing compression strokes), along with correct sequencing of valves, achieve constant flow, positive displacement system. Along with these characteristics, the system will enjoy the benefit of increased harmonic control characteristics, lending toward much less vibration than exhibit by prior art systems.

Finally, a critical aspect of this compressor is that it requires a means for driving each piston in a substantially axial direction. The term "substantially axial" refers to the requirement to provide a purely axial force to the piston perpendicular to the piston's face such that any non-axial forces are negligible. Some of the advantages gained by this form of drive means are: 1) little or no piston/cylinder lubrication is required; 2) friction is reduced and efficiency is improved. There are a number of possible ways to achieve this, some of which will be discussed as preferred embodiments, and all of which are considered to form a part of this invention.

A 1st Preferred Means for Driving Pistons in a Substantially Axial Manner

Figure 2:
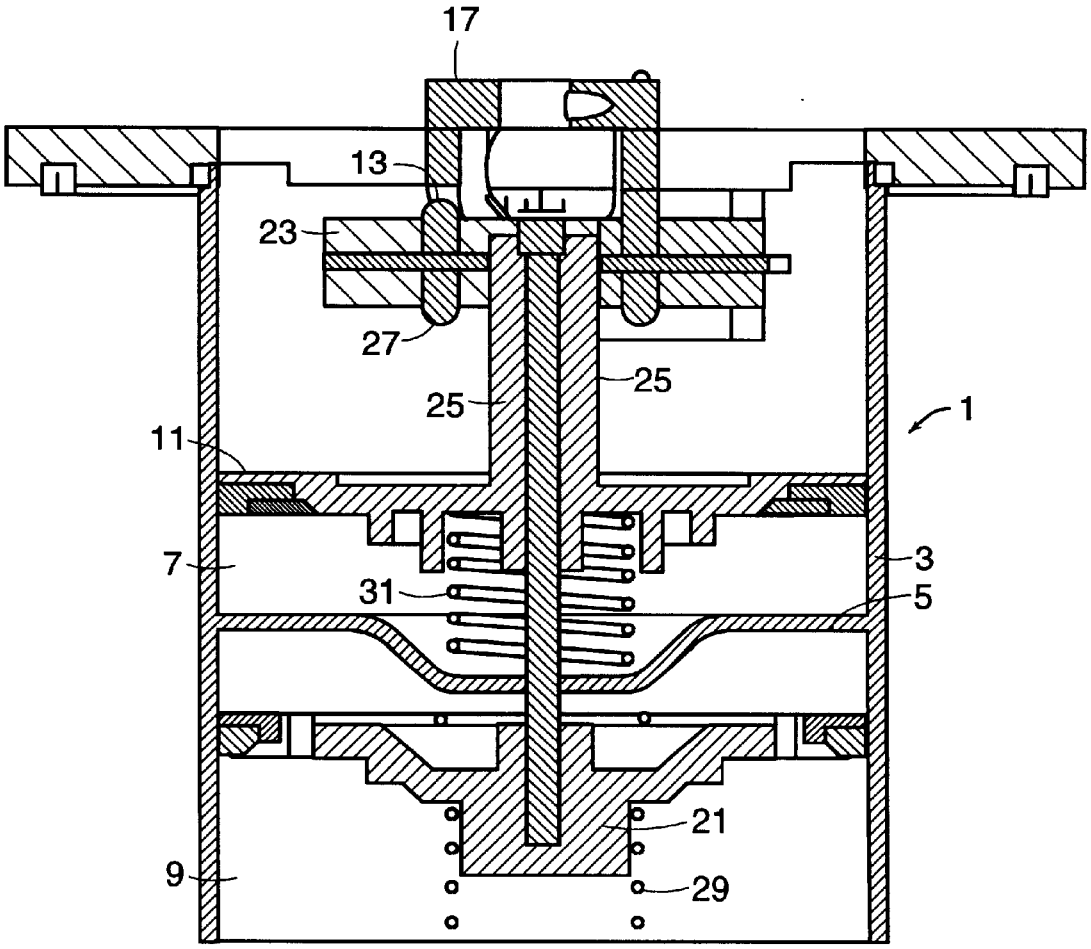
FIG. 2 is a view similar to FIG. 1 rotated ninety degrees.

One preferred means for driving the pistons in a substantially axial manner comprises a rotating cam 17 driving a cam follower 13 via a roller 19, which in turn drives the piston 21 via a connecting rod 15. Similarly by looking at FIG. 2, it can be seen that the piston 11 is made to reciprocate in the chamber 7 by being driven by a cam follower 23 via rods 25, the cam follower 23 in turn is driven by the cam 17 via another roller 27. The pistons are driven in this manner to eliminate the introduction of side forces thus minimizing friction and wear.

Figure 3:
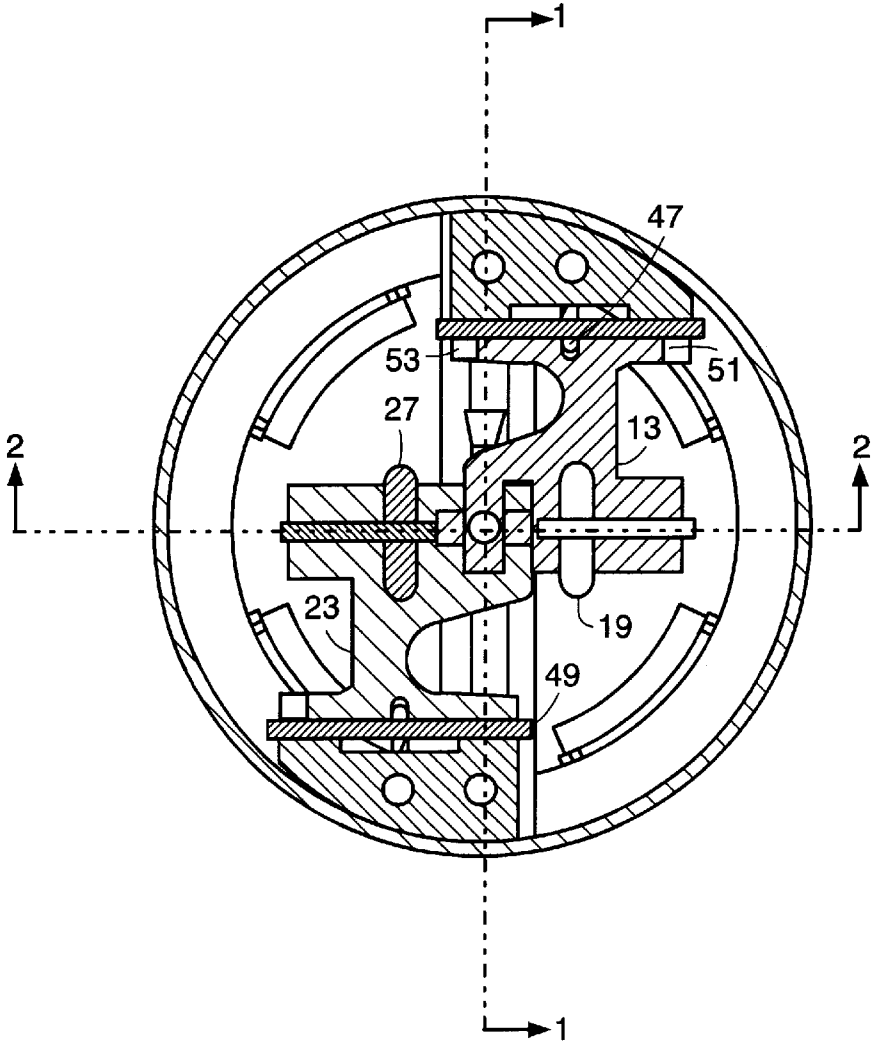
FIG. 3 is a top cross-sectional view of the FIG. 1 compressor.
Figure 4:
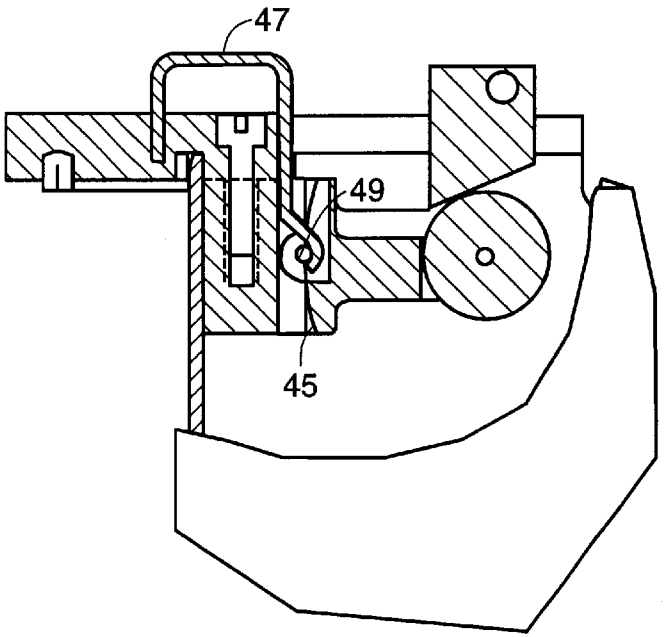
FIG. 4 is a cutaway detail view of a cam follower portion of the FIG. 1 embodiment.

The rods 15 and 25 are preferably rigidly affixed to their respective pistons. The rod 15 rides within a receiving pocket 41 within the cam follower 13 and each of the rods 25 in turn ride within similar receiving pockets 43 of the cam follower 23. The centers of rotation in each of the pockets 41 and 43 are made to oscillate about the axial centerline of the rod 15 and rods 25. Each cam follower is made to pivot about the cylinder side wall. For instance, looking to FIGS. 1 and 3, the cam follower 13 is depicted. A first end of the cam follower 13, that end opposite pocket 41 is arced. This arced surface 45 enables the cam follower to pivot against a suitable surface at the side wall of the cylinder. In FIG. 4, one manner of accomplishing this is depicted. A biasing means such as a spring 47 maintains contact between the arced surface 45 and the surface at the side wall of the cylinder. As such, the spring and the cam follower are coupled together by a coupling means such as a pin 49. The pin 49 passes through the cam follower 13 and rides in slots 51 and 53. The cam follower 23 is held in place in a similar fashion.

A 2nd Preferred Means for Driving Pistons in a Substantially Axial Manner

Figure 5:
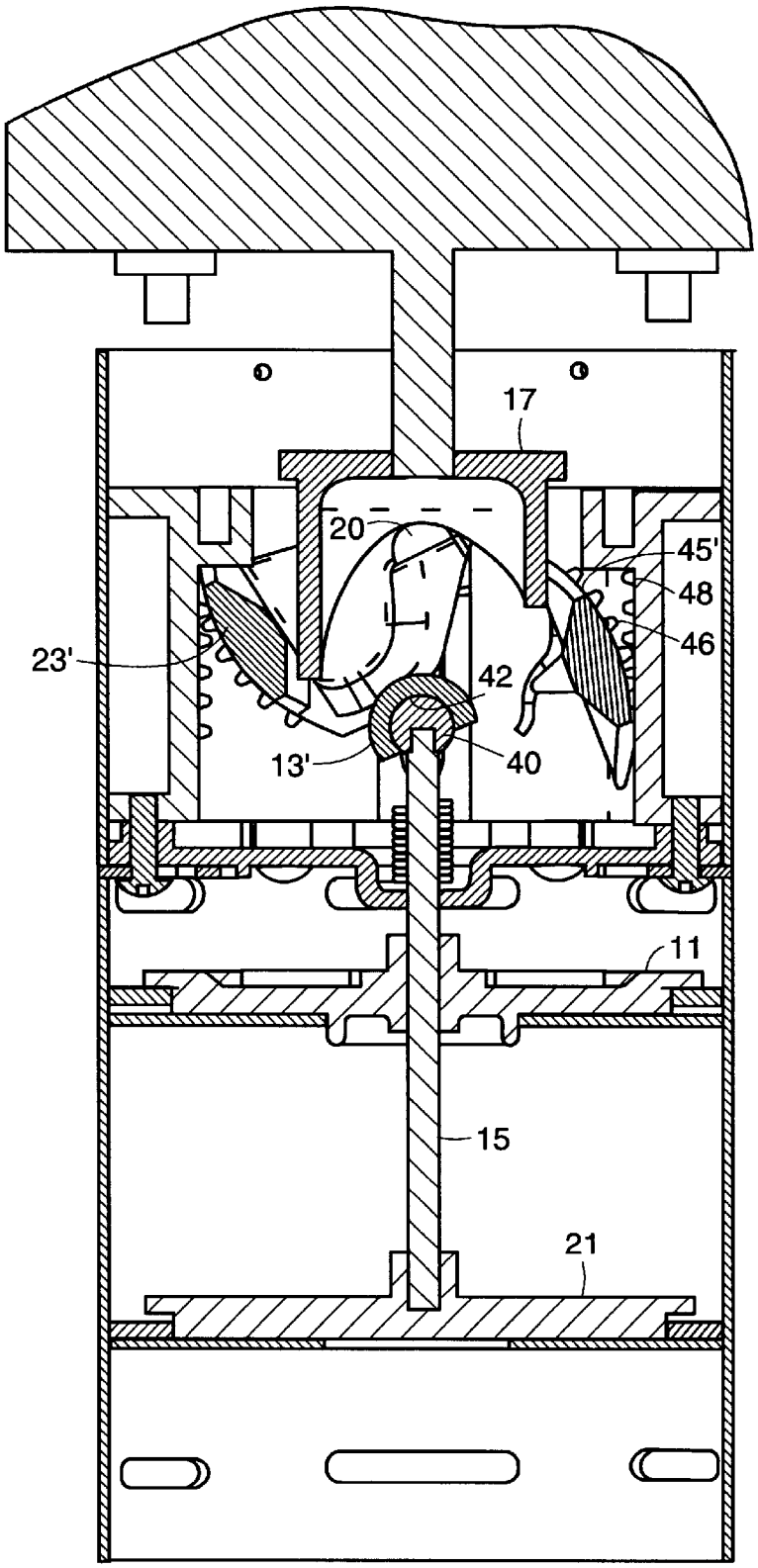
FIG. 5 is a diagrammatic cutaway view of a second preferred embodiment of a compressor in accordance with a preferred embodiment of the invention.
Figure 6:
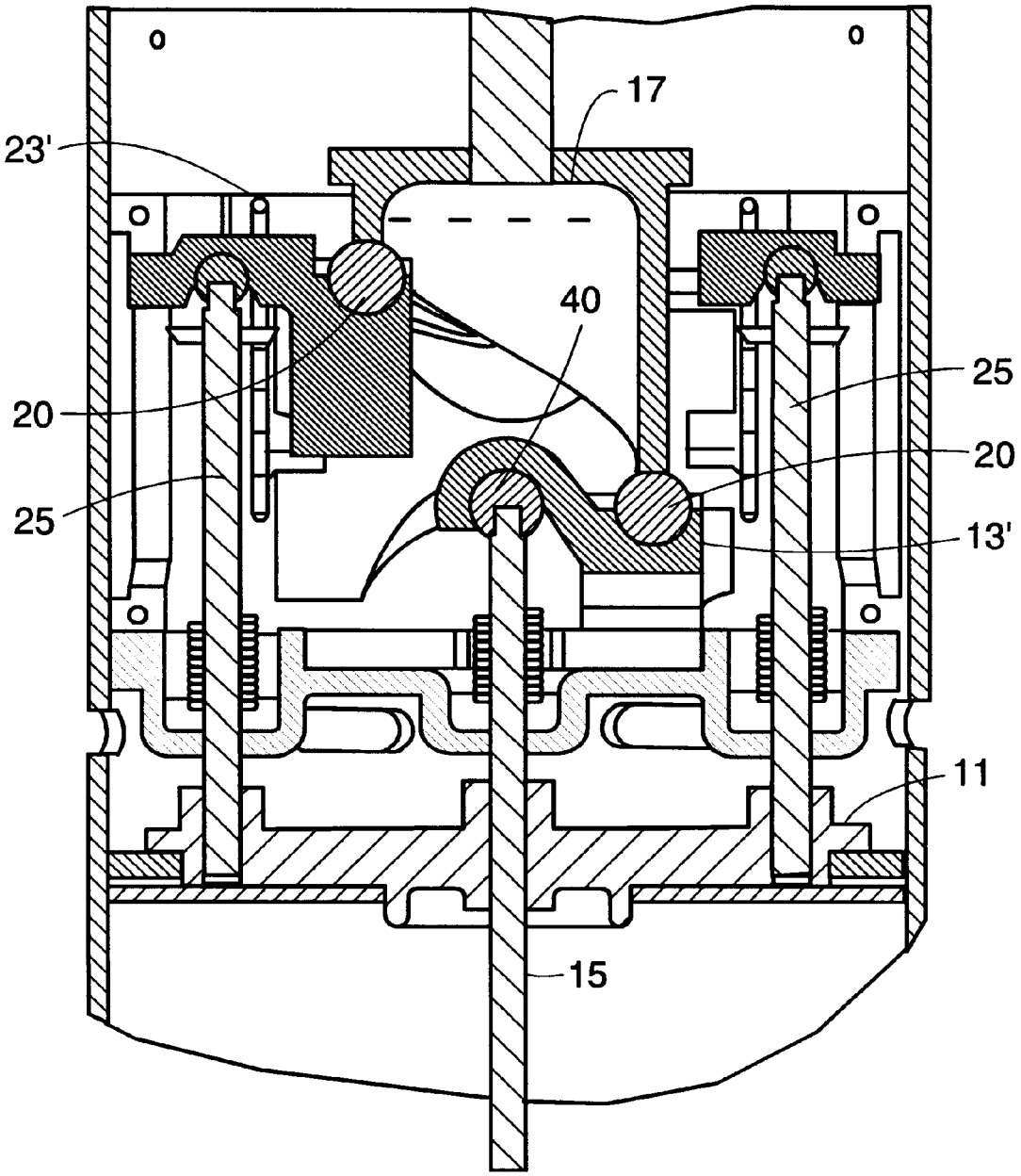
FIG. 6 is a sectional view of FIG. 5 rotated ninety degrees.
Figure 7:
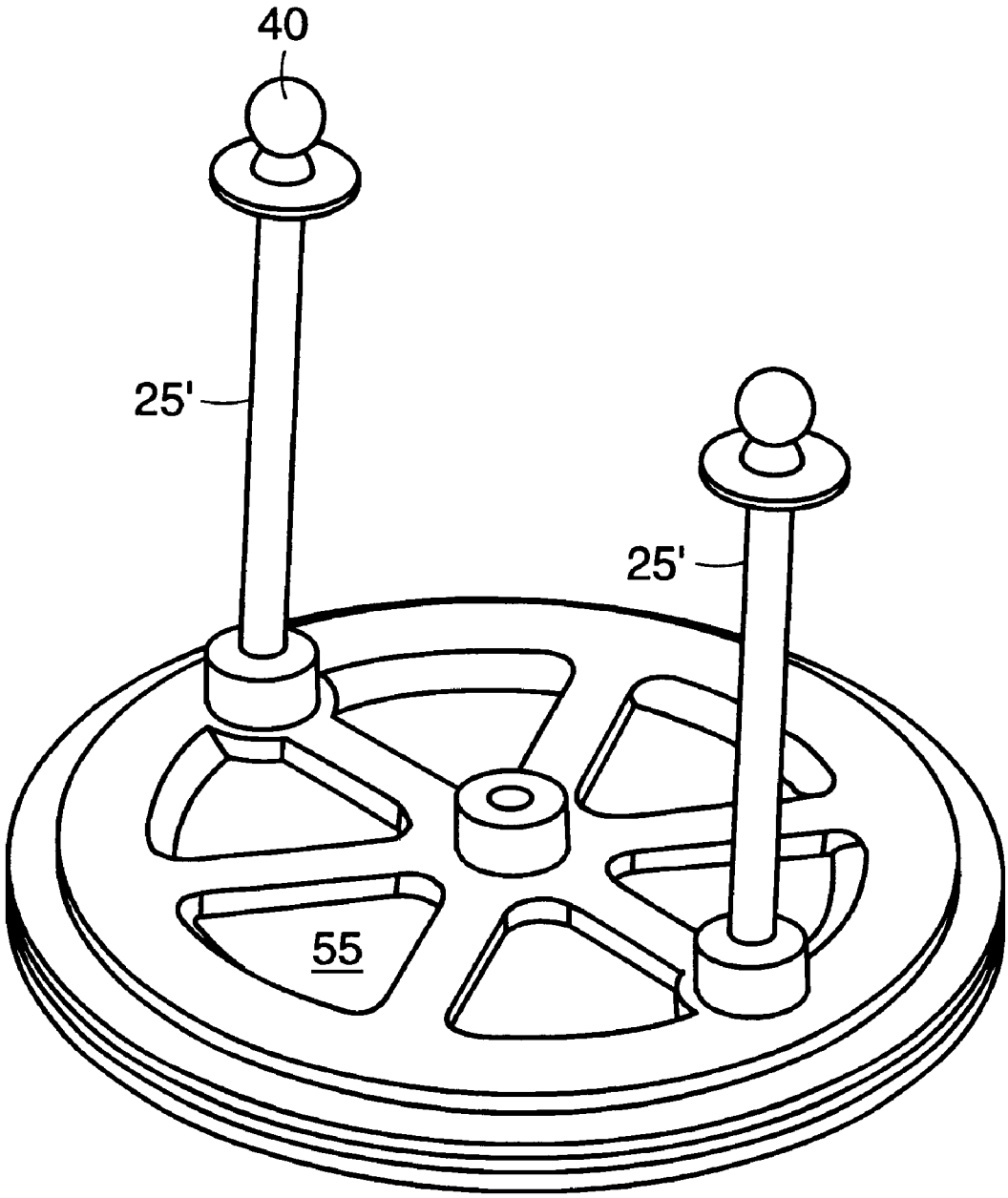
FIG. 7 is an isometric view of a piston for use in a preferred embodiment of the invention.

Another preferred means for driving the pistons in a substantially axial manner is depicted in FIGS. 5 and 6. To ease explanation, those items which remain substantially identical between each embodiment are identified with the same numbers. The items which are not identical but perform the same function are labeled with the same number followed by a prime (').Items which substantially differ between embodiments are given entirely different numbers. That being said, as in the first preferred embodiment, a rotating cam 17 drives a cam follower 13' which is maintained in continuous contact with the cam 17. In order to decrease friction between the two components yet provide for continuous but moving contact, a preferred means is to utilize a semi-spherical contact surface 20. This contact surface is formed as a profile within the cam follower 13' or alternatively comprises a sphere affixed within said cam follower or alternatively embedded within said cam follower but allowed to rotate therein. The desirable feature being that the sphere can rotate in any direction allowing full rolling contact with the cam. The cylindrical rollers previously described roll about the fixed axis and forces not in line with rotation cause skidding of the roller on the cam. Again, a cam follower 23' is also provided which operates the second piston in a similar manner.

Rods 15 and 25 are provided to drive the pistons 11 and 21. The rods 25 perform the same function as the rods of the first embodiment, however, their relative placement as measured from the axial centerline of the rod 15 differs. Fundamentally, placement of the rods is not important so long as the piston is made to reciprocate within its cylinder and placement of the rods introduces negligible side loading. The rods 15 and 25 are also provided with a semi-spherical contact surface 40 similar to the surface 20. Means for receiving and slidably engaging the surface 40 are provided for in each of the cam followers 13' and 23'. A preferred configuration for said means would be a receiving socket 42. Interaction between the surfaces 40 and said surface's respective socket 42 would be in the manner of a ball and socket joint.

Each cam follower further comprises at one end an arced surface 45', the arced surface is toothed with a plurality of gear teeth 46. These gear teeth are made to ride in a mating set of rack teeth 48 disposed in or against the cylinder side wall. The arced surface 45' is curved such that it forms a sector of the pitch circle of the gear teeth 46. The gear teeth hold the followers in place against inertial forces and torsional forces imposed by the offset of the cam contact points and drive rod contact points.

A 3rd Preferred Means for Driving Pistons in a Substantially Axial Manner

Figure 11:
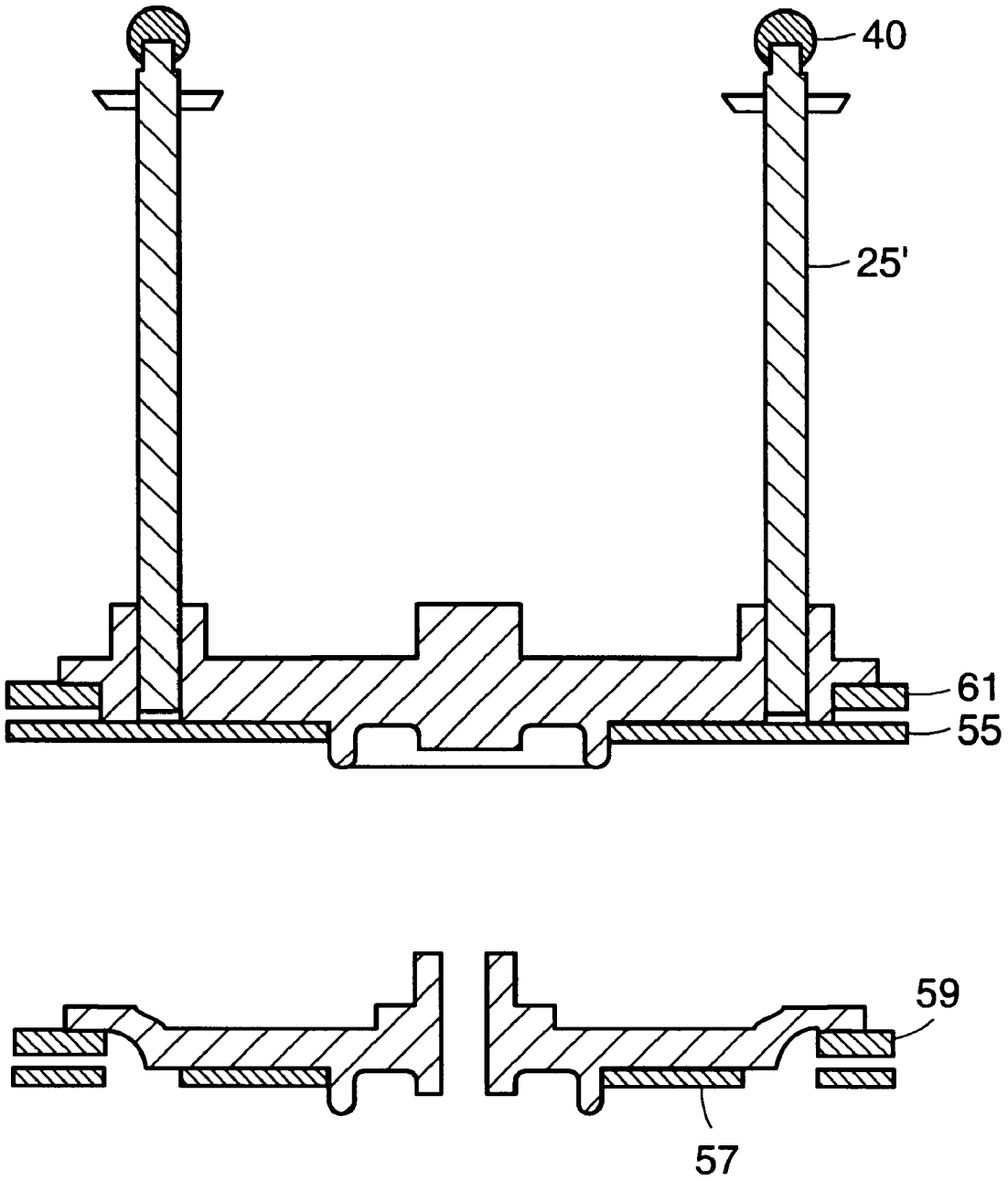
FIG. 11 depicts in cross-section the check valves associated with each piston.

A third means for driving the pistons in a substantially axial manner is depicted in FIG. 11. This means requires the application of a magnetic field and the use of spring biasing means to oppose the magnetic force thus causing the pistons to reciprocate. The piston 21 is moved to a first position by a magnet 111 via a magnetic core 117 and the rod 15. When the magnetic core 117 is demagnetized, the piston is released. The piston is then pushed against the pressure head by a spring biasing means 115, thereby creating a compression stroke. Similarly, the piston 11 is operated by a magnet 109 via a magnetic core 121 and a sleeve 123 within which rod 15 reciprocates. When the piston 21 is released, it too is pushed against the pressure head by a biasing spring 113.

The magnets 109 and 111 can be energized 180 degrees out of synchronization so that the pistons are moving in opposite directions. In the preferred embodiment of this compressor, the downward stroke of each piston takes more time than the upward stroke. Thus, there is no gap in the downward working strokes. The force on the pistons is constant over the stroke length so that a continuous flow of vapor is produced at constant pressure.

At the present time, the following fourth preferred means comprises the best mode of practicing the invention. It should be iterated that in reciting the various embodiments, concepts from each are cross-adaptable. Furthermore, other similar methods of driving the pistons in a substantially axial manner can be adapted for use in this invention. As such all alternative embodiments within the spirit of the invention are considered to form a part of the invention.

A 4th Preferred Means for Driving Pistons in a Substantially Axial Manner

Figure 15:
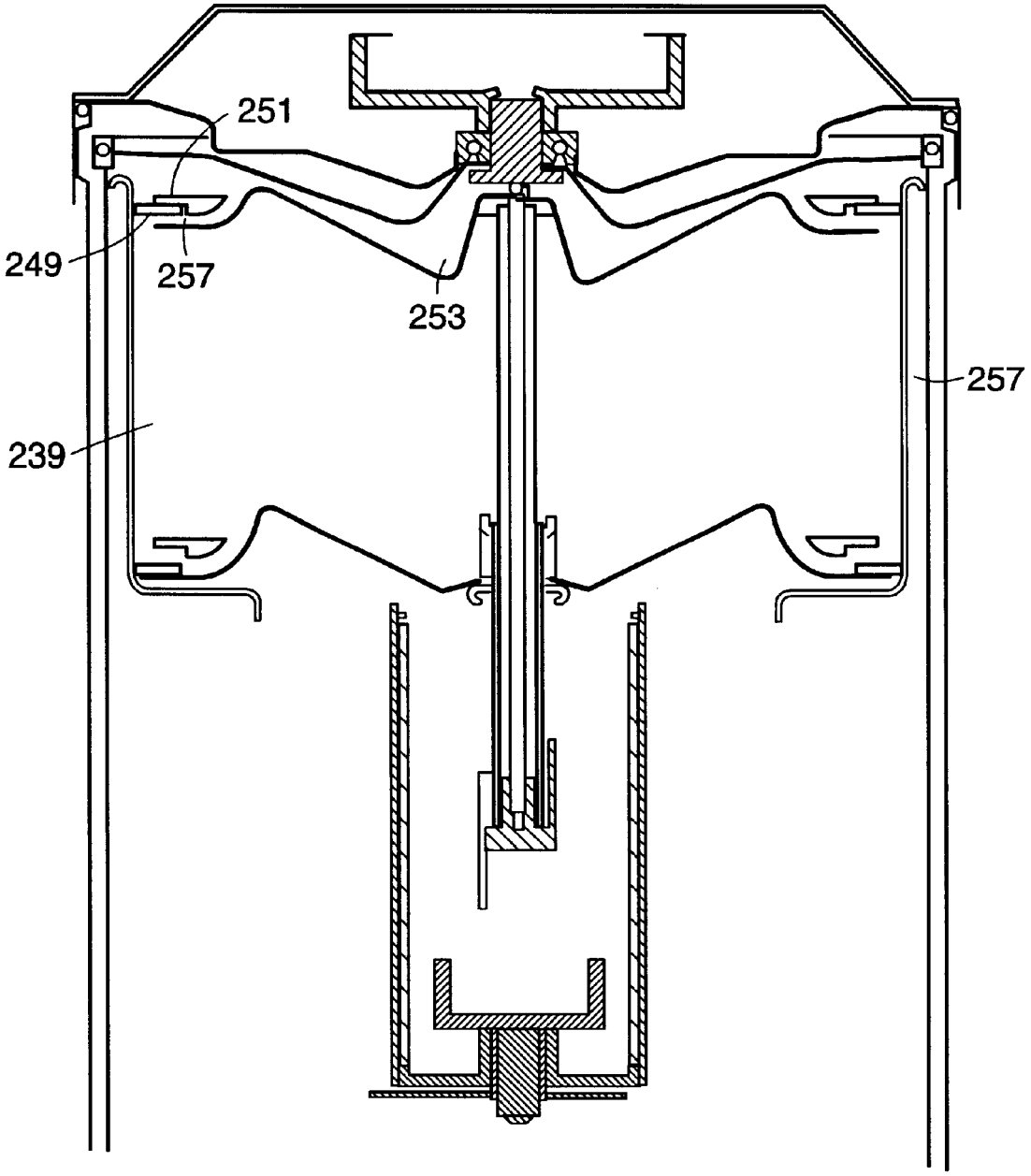
FIG. 15 is a further cross-sectional elevation depicting the fourth preferred embodiment of a compressor.
Figure 16:
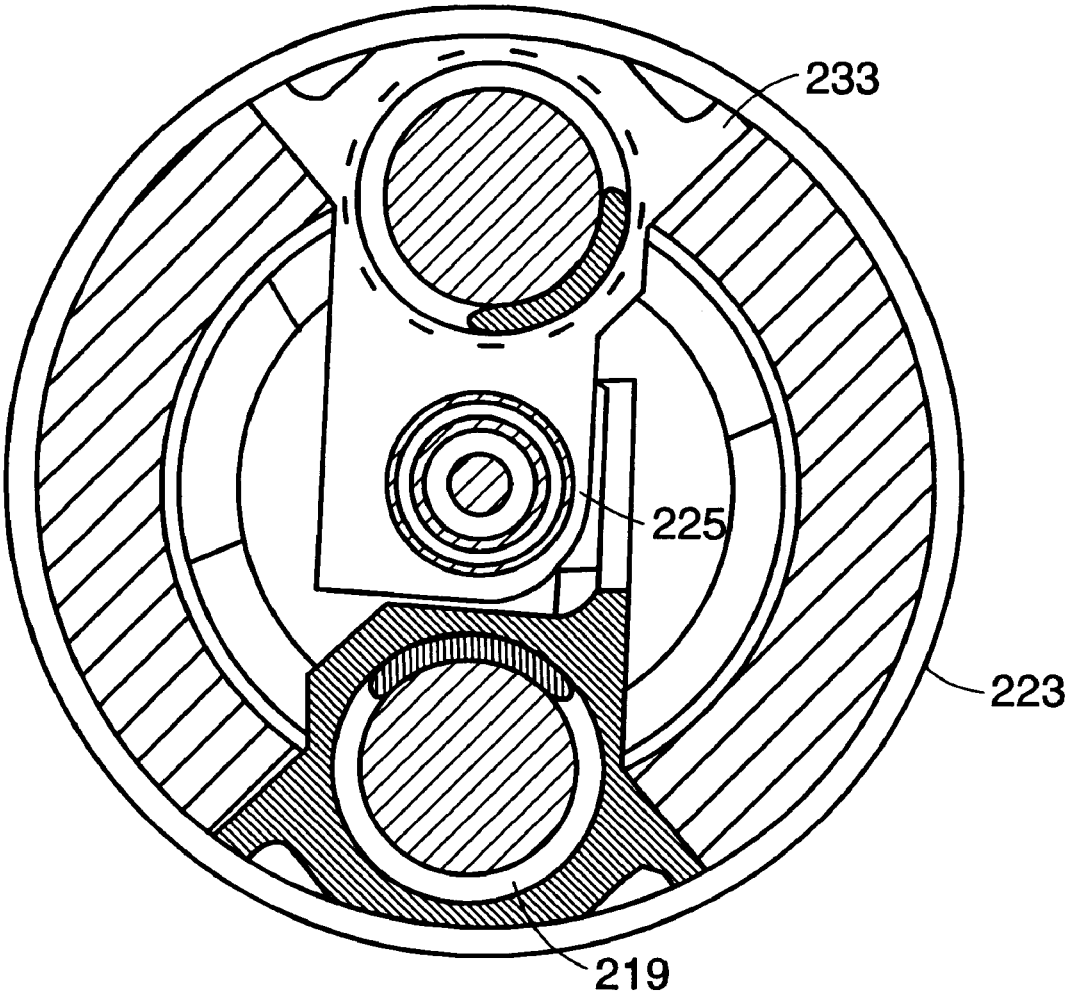
FIG. 16 is a top cross-sectional view of the FIG. 14 compressor.

Another preferred embodiment of this compressor is shown in FIGS. 15 thru 17. Cam 202 is fastened to stationary plate 204 via nut 206. The compressor assembly 208 rotates about stationary cam 202 supported by bearing 210 held by plate 211 which combined with cylinder 213 and other parts not shown forms a housing for the rotating assembly. The rotating assembly is driven by a motor, (not shown), via a gear 215. The rotating assembly is held on a stable axis by bearing 217, which rotates about a shaft on cam 202. Slider 219 slides on ways 221 fixed to cylinder 223 so as to drive rod 225 and attached piston 227 to move parallel to the axis of rotation. Roller 229 fixed to slider 219 via shaft 231 follows the contour of cam 202 to impart the linear motion to slider 219. Likewise, slider 233 moves piston 235 via rod 237.

A small volume of a lubricating fluid, such as oil, is contained inside cylinder 223 to provide lubrication. The volume may be such that when the system is at rest in a vertical orientation the free surface of the volume is below the top of bearing 217 to prevent leakage thru bearing without the use of a seal. When the system is rotating the oil is moved outward and therefore also upward to lubricate the ways and rollers. The volume of oil is such that during rotation it will remain away from the axis of rotation. This is to prevent any oil from being forced upward along rods 225 and 237 and then into the working chamber 239 in which the pistons reciprocate. A seal 241 for rod 225 and seal 243 for rod 237 can be provided as an additional assurance and to minimize the entrance of the fluid in chamber into the lubricated assembly.

In a preferred embodiment, the fluid in chamber 239 is steam and the seals may be eliminated because the steam will not harm the lubricated assembly and will not condense because the temperature of the lubricated assembly will be at least slightly higher than the saturation temperature of the steam The pistons are fully guided by their rigid connection to the slides and do not slide on cylinder 245 but run freely with in cylinder 245. The pistons are sealed to cylinder 245 with piston rings that float within the pistons but do not guide them.

Piston 235 is shown at the bottom of its stroke with its piston ring 247 against the edge of piston 235 to create a seal between the ring and the piston. Another seal is made between piston ring 247 and cylinder 245 by the small clearance the two. Piston 235 is thereby sufficiently sealed to cylinder 245 so that when it is driven upward the fluid in chamber 239 will be pressurized. Piston 227 is shown at the top of its stroke and piston ring 249 is shown against retainer 249 thereby leaving a passage 251 between chamber 239 and exit chamber 253 so that as piston 227 descends toward piston 235 the fluid in chamber 239, being pressurized by piston 235 will be driven to exit chamber 253, the volume above piston 227, which is open to exit ports 255 and exit passage 257. When piston 227 reaches the bottom of its stroke, its piston ring 249 will move down to seal against the piston under the influence of inertia forces and then be held by fluid pressure forces as piston 227 starts its upward pressurizing stroke. By these actions piston rings 247 and 249 act as valves for pistons 235 and 227 respectively. This allows for large passages when the valves are open and introduces no leak path that does not already exist with any piston ring design. Both these features improve compressor efficiency.

Operation of the Compressor

In any of the embodiments of the present invention which utilize two pistons, i. e., pistons 11 and 21, each piston is timed to perform its respective compression stroke in opposition to the other as explained more fully below. Timing of the pistons in this manner forms an important aspect of this invention. It tends to smooth out the functioning of the apparatus. If more than two pistons are utilized, the compression stroke of each additional piston will have to be adjusted appropriately to minimize vibration throughout the system.

Figure 8:
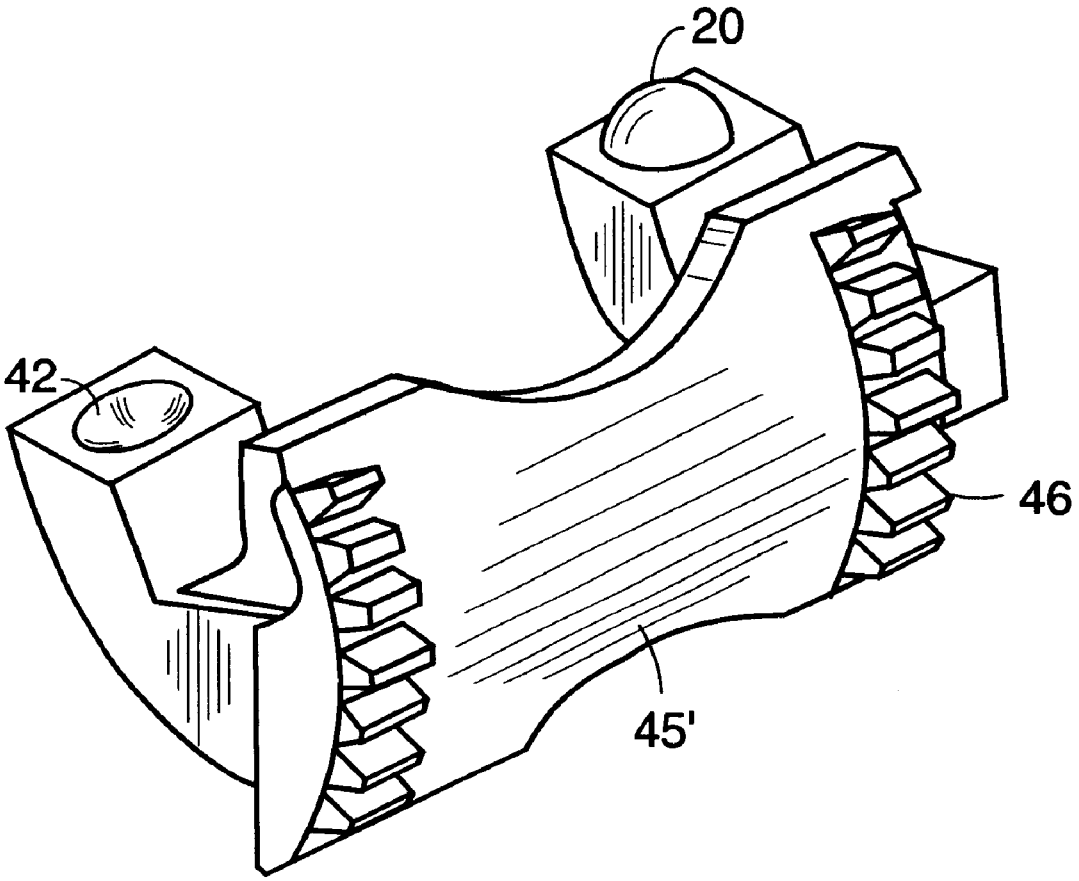
FIG. 8 is an isometric view of a cam follower portion of the FIG. 5 embodiment.
Figure 9:
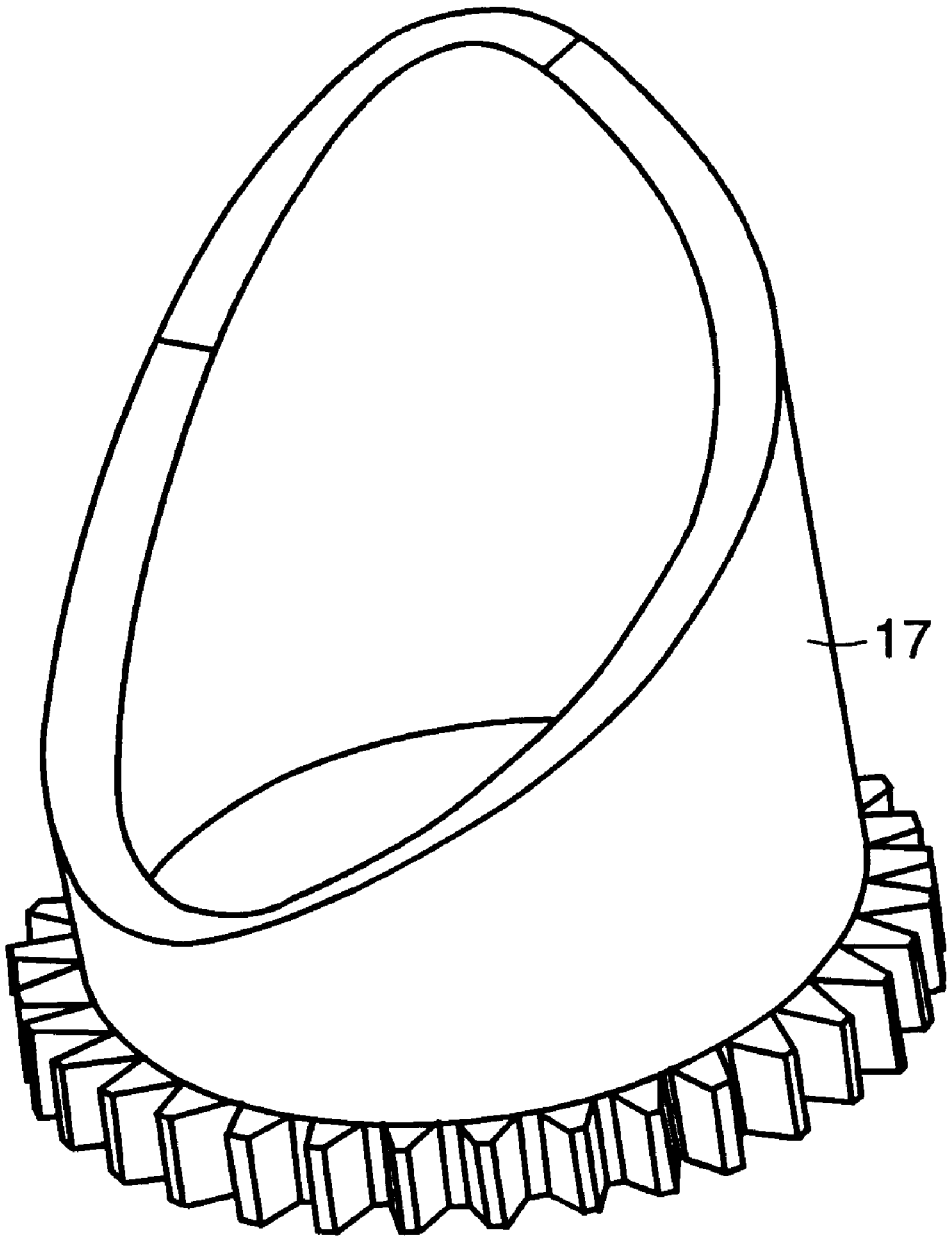
FIG. 9 is an isometric view of a drive cam used in each embodiment of the compressor.
Figure 10:
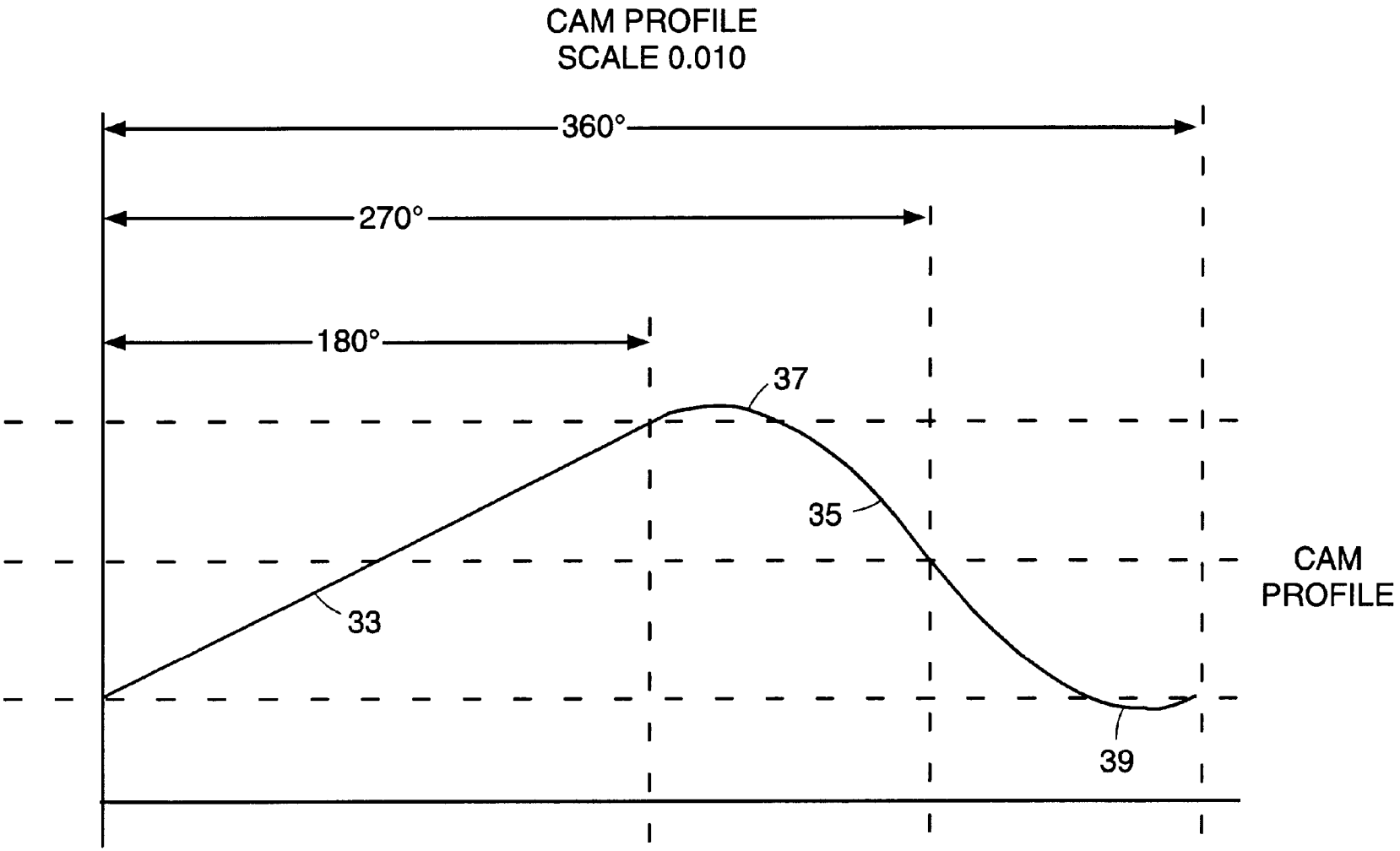
FIG. 10 is a depiction of the profile of the FIG. 9 drive cam over a single 360 degree revolution of the cam.

Nevertheless, resorting to the preferred embodiment comprising two pistons, the cam 17 is depicted in FIG. 8 and its profile is depicted in FIG. 9. Looking at these FIGS. in conjunction with FIG. 1, it can be seen that compression occurs as the pistons are moved away from the cam. The cam 17 drives the pistons against the biasing springs 29 and 31. The spring 29 returns the piston 11 to its original position while the spring 31 returns the piston 21 to its original position.

The profile of the cam 17 enables the speed of the compression stroke of each piston to remain constant and eliminate any significant period where neither piston is moving downward. By looking at FIG. 9 with respect to any one piston, for instance piston 11, a pattern will emerge. The pattern is identical for each piston, it is only delayed by some factor for any subsequent number of pistons.

Using as a reference base, the revolution of the cam 17, and starting at zero degrees of revolution, the following will occur. From zero degrees to 180 degrees, the piston is driven downward by the cam to form a compression stroke identified as 33 on the cam profile. The slope of the compression stroke as stated above is constant. The reversing and return portion 35 of the cam profile encompass the remaining 180 degrees of cam rotation. More specifically, at the end of the compression stroke or at the 180 degree mark, the direction of piston travel is reversed during a brief interval of overtravel labeled section 37. This reversal is accomplished in as short an interval as practical, so that by 270 degrees of cam rotation the piston is returned to its midpoint for its entire stroke length.

Subsequently, the piston's direction of travel is reversed again when it reaches section 39 which also is accomplished in as short an interval as practical. The acceleration forces occurring at each piston travel reversal, i.e., sections 37 and 39 are made to be substantially equal in scale. The forces are induced at a point as close to 180 degrees apart as possible in order to minimize vibration. By introducing the reversal forces in the latter 180 degrees of rotation of one piston, that piston is prevented from reversing before the other piston completes its compression stroke Though making the compression stroke last 180 degrees of revolution forms the preferred embodiment, a level of pre-compression can be introduced into the system by allowing the compression stroke of the piston 11 to extend more than 180 degrees. Since fluid enters the first chamber of the compressor and subsequently moves through the second chamber of the compressor, a compression stroke longer than 180 degrees enables full compression to take place and still have 180 degrees of delivery to the second chamber to avoid pulsation.

The fluid path through the apparatus begins when vapor flows into the compressor via a suitable path. The vapor enters the first chamber 7 through a flow control means such as a check valve 55 in the piston 11. At some point at or near the end of the compression stroke of the piston 11, the vapor enters the second chamber 9 through a check valve 57 of the piston 21. The now compressed fluid is pushed out of the chamber 9 by the piston 21 in a continuous fashion so that the outlet flow is substantially constant. Each of the check valves 55 and 57 would preferably comprise thin flexible washers that float within a defined cavity. Piston cylinder rings 59 and 61 are provided and held captive within the pistons 21 and 11 respectively. The check valves 55 and 57 seal against the piston rings. This construction eliminates a leak path between the piston and its respective piston ring, which is usually found in conventional designs. To eliminate the need for lubrication other than that provided by the fluid, the piston rings should be made of a low friction polymer, such as polytetraflouroethylene (Teflon®), polyetheretherketone (PEEK®), or another polymer having similar characteristics. PEEK with Teflon impregnated therein provides the most suitable combination currently anticipated.

Whereas the mechanical operation of the invention has been described above, in its preferred embodiment it can be utilized as a compressor, a pump, or for example, a compressor within a vapor compression distillation system. Of course the apparatus can be adapted to provide higher compression ratios and thus its potential uses would increase.

Figure 12:
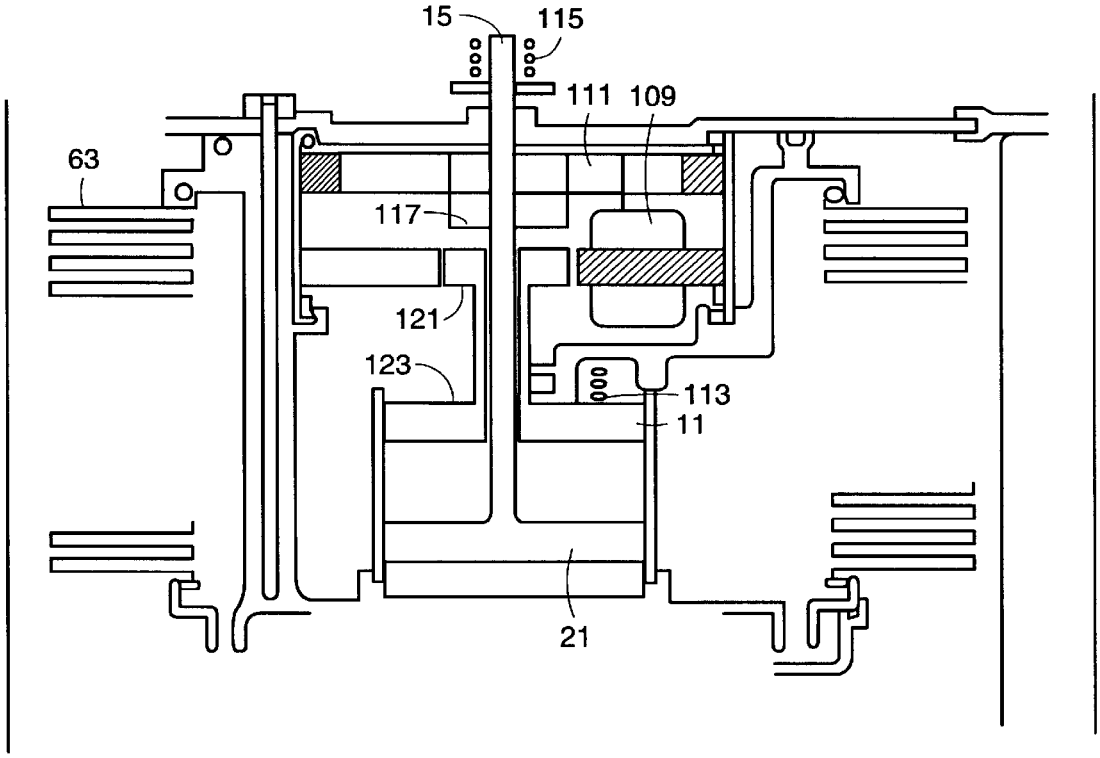
FIG. 12 is a cross-sectional elevation depicting a third preferred embodiment of axial driving means for use in a compressor in accordance with a preferred embodiment of the invention.
Figure 13:
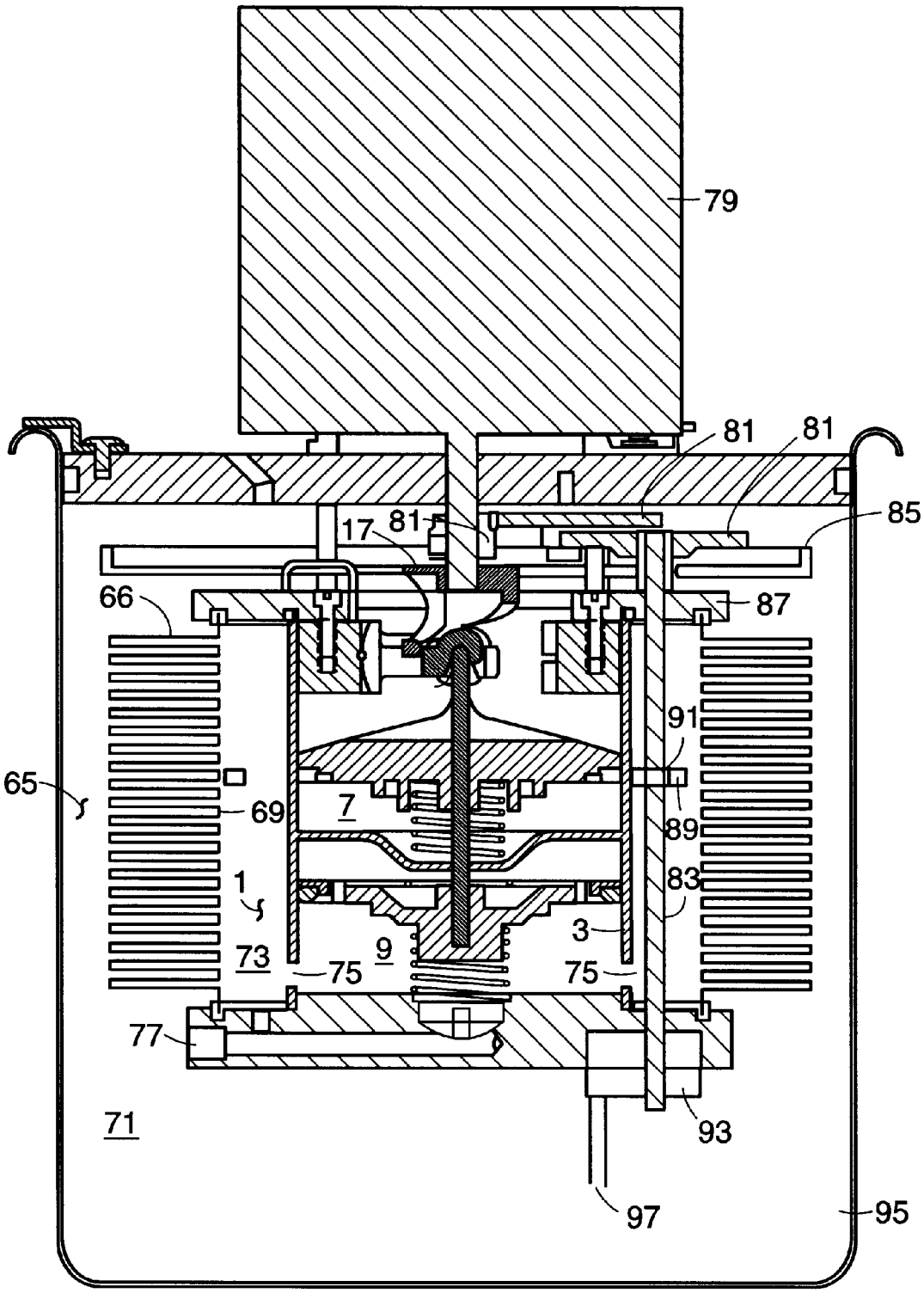
FIG. 13 is a cross-sectional elevation of the compressor embodied within a vapor compression distillation unit.
Figure 14:
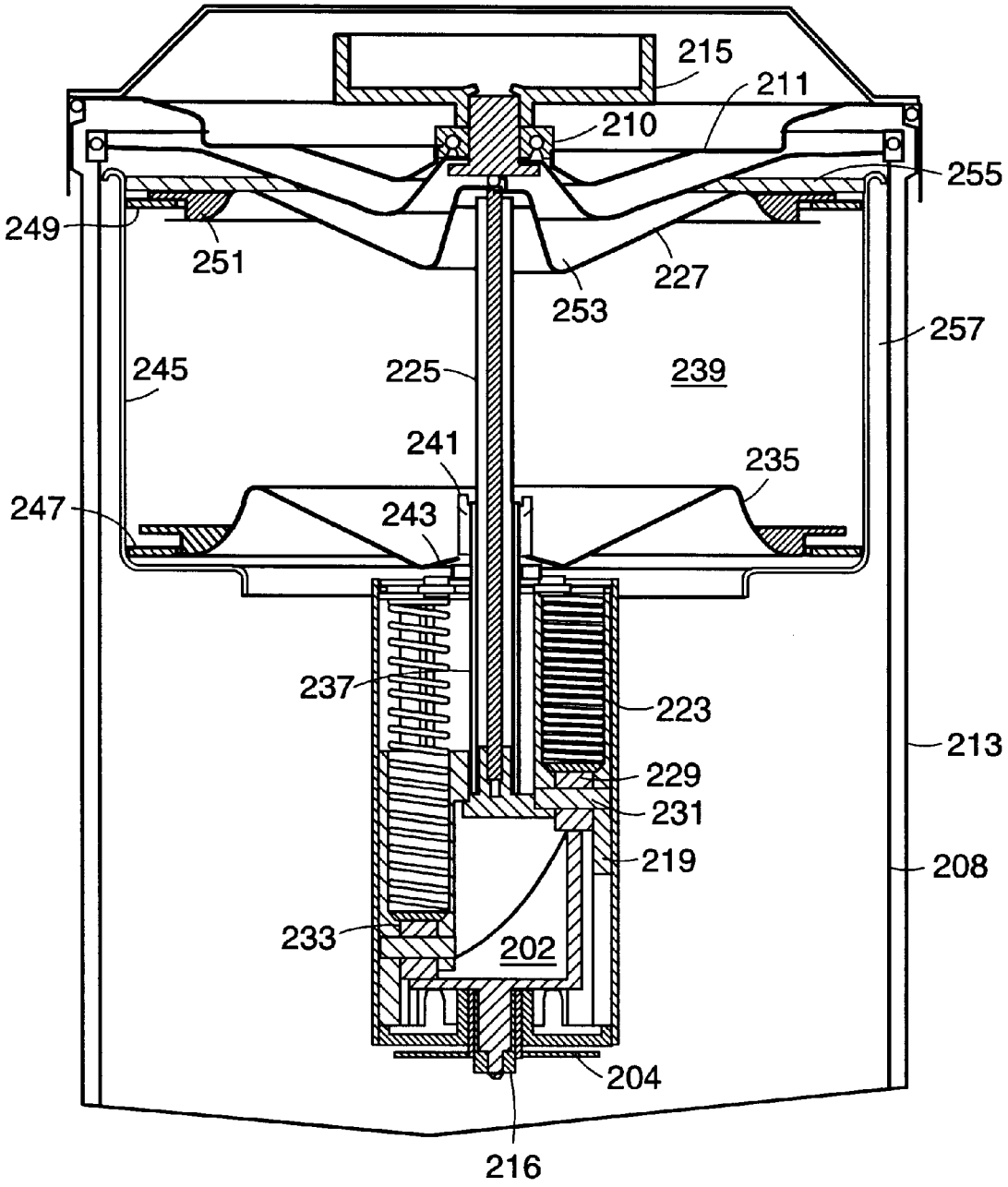
FIG. 14 is a cross-sectional elevation depicting one preferred embodiment of a compressor in accordance with the fourth preferred embodiment of the invention.

Turning now to FIG. 12, the apparatus is depicted as part of a simplified vapor compression distiller 63. The compressor 1 is installed in the cavity of a heat exchanger 65, which in one variation can be made in the form of a corrugated cylinder 66 comprising an outer evaporator surface 67 and an inner condensing surface 69. The entire cylinder 3 sits within an evaporator chamber 71, which is in turn sealed from a condenser chamber 73 by the corrugated cylinder 66. Vapor is drawn into the first chamber 7, passes through the check valve 55 into the first chamber 7, is compressed by the first piston 11, passes through the check valve 57 into the second chamber 9 where it is transported at a constant pressure by the second piston 21. The now compressed vapor exits the cylinder 3 through a suitable opening 75 into the condenser chamber 73 where it is condensed and removed via a drain port 77. Losses of efficiency in a compressor designed in this fashion are more related to flow not friction. If the check valves 55 and 57 are made as large as practical, even approaching the size of the entire piston face, losses in efficiency are reduced.

In order to operate more effectively as an evaporator, a thin film of liquid is applied to the evaporator surface 67 by rotation of an array of liquid applicators. A motor 79 is utilized which drives cam 17, to drive the compressor, and also drives the applicators via a plurality of gears 81 adapted to drive a shaft 83 which in turn drives a rotating tray 85 via an attached pinion 87. Affixed to the shaft 83 is a pinion 91, which engages a ring gear 89. The rotating tray 85 drives a plurality of applicator mechanisms that apply liquid to the evaporator surface 67 while the ring gear 89 drives a set of wiper mechanisms that remove condensate from the condensing surface 69. The shaft 83 can also be adapted to drive a gear pump 93 which pumps a liquid from a sump 95 via a port 97 to be delivered to a tray 85 from where it is distributed to the applicator mechanisms for subsequent evaporation.

As such the method of making and using the device described above constitutes a preferred embodiment and alternative embodiments of the invention. The inventor is aware that numerous configurations of the device as a whole or some of its constituent parts are available which would provide the desired results. While the invention has been described and illustrated with reference to specific embodiments, it is understood that these other embodiments may be resorted to without departing from the invention. Therefore the form of the invention set out above should be considered illustrative and not as limiting the scope of the following claims.

I claim:

1. A compressor of the type that forms a compressor inlet and compressor outlet, draws fluid in through the compressor inlet, compresses fluid thereby drawn thereinto, and drives the fluid thus compressed from the compressor outlet, wherein:

A) the compressor includes a sequence of at least a first piston and a separate last piston, each piston providing respective upstream and downstream faces, the upstream face of the first piston being in communication with the compressor inlet, and the downstream face of the last piston being in communication with the compressor outlet;

B) the compressor includes a piston driver that causes each piston to travel alternately in upstream and downstream directions out of phase with at least one other said piston;

C) for each piston, the compressor forms a piston chamber in which that piston ton is slidably disposed and communicates with the compressor outlet during at least part of the time during which that piston travels in the downstream direction, each piston but the last being continuously disposed in such fluid communication with the next that the piston-chamber pressure sure prevailing on that piston's downstream face is substantially the same as the piston-chamber pressure prevailing on the next piston's upstream face; and D) the compressor includes check valves that permit fluid flow from upstream to downstream of each piston but substantially prevent fluid flow from downstream to upstream thereof.

2. A compressor as defined in claim 2 wherein the check valves include a check valve mounted on each piston for travel therewith.

3. A compressor as defined in claim 1 wherein the number of pistons is two.

4. A compressor as defined in claim 3 wherein the check valves include a check valve mounted on each piston for travel therewith.

5. A compressor as defined in claim 1 wherein the pistons reciprocate in such a phase relationship that whenever one of the pistons travels upstream at least one other said piston is traveling downstream.

6. A compressor as defined in claim 5 wherein the number of pistons is two.

7. A compressor as defined in claim 1 wherein, for any given compressor speed, there is a substantially constant volume rate of piston travel at which every piston travels when it is the piston traveling fastest upstream.

8. A compressor as defined in claim 7 wherein the number of pistons is two.

9. A compressor as defined in claim 8 wherein each piston travels downstream at the constant rate for at least half of each cycle of reciprocation.

10. A compressor as defined in claim 1 wherein the pistons are coaxially disposed with respect to each other.

11. A compressor as defined in claim 10 wherein the check valves include a check valve mounted on each piston for travel therewith.

12. A compressor as defined in claim 10 wherein the number of pistons is two.

13. A compressor as defined in claim 1 wherein the piston chamber in which each piston is disposed is the same as the piston chamber in which every other piston is disposed.

14. A compressor as defined in claim 13 wherein the check valves include a check valve mounted on each piston for travel therewith.

15. A compressor as defined in claim 13 wherein the pistons are coaxially disposed with respect to each other.

16. A compressor as defined in claim 13 wherein the number of pistons is two.

17. A compressor as defined in claim 1 wherein the piston driver includes, associated with each piston, a rotary-motion source, a cam to which the rotary-motion source imparts rotary motion, and a cam follower so operatively connected to the cam and cam follower that the cam's rotation causes reciprocating motion of the piston.

18. A compressor as defined in claim 17 wherein the rotary-motion source associated with each piston is the rotary-motion source associated with each other piston.

19. A compressor as defined in claim 18 wherein the cam associated with each piston is the cam associated with each other piston, but the cam follower associated with each piston is separate from the cam follower associated with each other piston.

20. A compressor as defined in claim 17 wherein, for any given compressor speed, there is a substantially constant volume rate of piston travel at which every piston travels when it is the piston traveling fastest upstream.

21. A compressor as defined in claim 20 wherein the number of pistons is two.

22. A compressor as defined in claim 21 wherein each piston travels down stream at the constant rate for at least half of each cycle of reciprocation.

23. A vapor-compression distiller comprising:

A) a heat exchanger that forms an evaporation chamber that receives liquid to be distilled, a condensation chamber from which distilled liquid is discharged, and a heat-transfer medium that conducts heat from the evaporation chamber to the condensation chamber; and B) a compressor that forms a compressor inlet and compressor outlet, draws fluid from the evaporation chamber through the compressor inlet, compresses fluid thereby drawn thereinto, and drives the fluid thus compressed from the compressor outlet into the condensation chamber, wherein:

i) the compressor includes a sequence of at least a first piston and a separate last piston, each piston providing respective upstream and downstream faces, the upstream face of the first piston being in communication with the compressor inlet, and the downstream face of the last piston being in communication with the compressor outlet;

ii) the compressor includes a piston driver that causes each piston to travel alternately in upstream and downstream directions out of phase with at least one other said piston;

iii) for each piston, the compressor forms a piston chamber in which that piston is slidably disposed and communicates with the compressor outlet during at least part of the time during which that piston travels in the downstream direction, each piston but the last being continuously disposed in such fluid communication with the next that the piston-chamber pressure prevailing on that piston's downstream face is substantially the same as the piston-chamber pressure prevailing on the next piston's upstream face; and iv) the compressor includes check valves that permit fluid flow from upstream to downstream of each piston but substantially prevent fluid flow from downstream to upstream thereof.

24. A vapor-compression distiller as defined in claim 23 wherein the check valves include a check valve mounted on each piston for travel therewith.

25. A vapor-compression distiller as defined in claim 23 wherein:

A) the heat exchanger is a rotary heat exchanger that forms a central void; and

B) the compressor is disposed within the central void.

26. A vapor-compression distiller as defined in claim 25 wherein the pistons are coaxially disposed with respect to each other.

27. A vapor-compression distiller as defined in claim 23 wherein the pistons reciprocate in such a phase relationship that whenever one of the pistons travels upstream at least one other said piston is traveling downstream.

28. A vapor-compression distiller as defined in claim 27 wherein, for any given compressor speed, there is a substantially constant volume rate of piston travel at which every piston travels when it is the piston traveling fastest upstream.

29. A vapor-compression distiller as defined in claim 28 wherein the number of pistons is two.

30. A vapor-compression distiller as defined in claim 29 wherein each piston travels downstream at the constant rate for at least half of each cycle of reciprocation.

31. A vapor-compression distiller as defined in claim 23 wherein, for any given compressor speed, there is a substantially constant volume rate of piston travel at which every piston travels when it is the piston traveling fastest upstream.

32. A vapor-compression distiller as defined in claim 31 wherein the number of pistons is two.

* * * * *

UNITED STATES PATENT AND TRADEMARK OFFICE

CERTIFICATE OF CORRECTION

PATENT NO. : 6,328,536 B1
DATED : December 11, 2001
INVENTOR(S) : William H. Zebuhr It is certified that error appears in the above-identified patent and that said Letters Patent is hereby corrected as shown below:

Column 9,
Line 57, replace “pressure sure” with -- pressure --.

Signed and Sealed this

Twenty-second Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,328,536 B1
DATED : December 11, 2001
INVENTOR(S) : William H. Zebuhr It is certified that error appears in the above-identified patent and that said Letters Patent is hereby corrected as shown below:

Column 9,
Line 42, replace "piston ton" with -- piston --.
Line 47, replace "pressure sure" with -- pressure --.

Column 10,
Line 29, replace "to the cam" with -- to the piston --.

Signed and Sealed this

First Day of April, 2003

JAMES E. ROGAN
*Director of the United States Patent and Trademark Office*